US007011746B2

(12) United States Patent
Böckmann

(10) Patent No.: US 7,011,746 B2
(45) Date of Patent: Mar. 14, 2006

(54) RAINWATER SURFACE DRAIN

(75) Inventor: Antonio Böckmann, Unterhaching (DE)

(73) Assignee: Ernst Zürn GmbH & Co. KG, (DE)

( * ) Notice: Subject to any disclaimer, the term of this patent is extended or adjusted under 35 U.S.C. 154(b) by 120 days.

(21) Appl. No.: 10/675,636

(22) Filed: Sep. 29, 2003

(65) Prior Publication Data

US 2004/0182763 A1 Sep. 23, 2004

(30) Foreign Application Priority Data

Mar. 20, 2003 (DE) ..... 203 04 489

(51) Int. Cl.
*B01D 35/02* (2006.01)

(52) U.S. Cl. ..... 210/164; 210/166; 210/474; 210/477; 4/289; 4/292; 52/302.1

(58) Field of Classification Search ..... 210/163, 210/164, 166, 170, 335, 339, 474, 477; 4/289, 4/292; 52/302.1
See application file for complete search history.

(56) References Cited

U.S. PATENT DOCUMENTS

| | | | | |
|---|---|---|---|---|
| 168,052 A * | 9/1875 | Robinson | 4/652 |
| 759,457 A * | 5/1904 | Meloney | 4/652 |
| 774,201 A * | 11/1904 | Robischon | 4/289 |
| 1,310,055 A * | 7/1919 | Lang | 210/164 |
| 1,622,652 A * | 3/1927 | Lang | 210/164 |
| 1,753,262 A * | 4/1930 | Cromwell | 210/166 |
| 1,988,669 A * | 1/1935 | Sommerfeld | 210/166 |
| 2,689,017 A | 9/1954 | Schmid | |
| 3,406,829 A * | 10/1968 | Bosche | 210/164 |
| 4,261,824 A * | 4/1981 | Cuschera | 210/164 |
| 6,254,770 B1 * | 7/2001 | Remon | 210/163 |
| 6,537,448 B1 * | 3/2003 | Houk | 210/164 |

FOREIGN PATENT DOCUMENTS

| | | |
|---|---|---|
| DE | NR. 202 05 749.6 | 4/2002 |
| GB | 2 269 402 A | 2/1994 |
| GB | 2 285 460 A | 7/1995 |
| GB | 2 321 067 A | 7/1998 |

* cited by examiner

*Primary Examiner*—Christopher Upton
(74) *Attorney, Agent, or Firm*—Ostrolenk, Faber, Gerb & Soffen, LLP

(57) ABSTRACT

A rainwater surface drain for use in roof drains comprises a substantially funnel-shaped reservatory for water to be drained and covered with an upper strainer or grating member downstream of which an eddy preventing insert means in the form of a flat grate member is disposed at a short distance upstream of a discharge outlet on the bottom side of the reservatory which is connected with an outlet pipe.

4 Claims, 2 Drawing Sheets

RAINWATER SURFACE DRAIN

FIELD OF THE INVENTION

The present invention relates to a rainwater surface drain for use in roof drains.

BACKGROUND OF THE INVENTION

U.S. Pat. No. 2,689,017 discloses a rainwater surface drain for use in roof drains of the kind incorporating a substantially cup shaped reservatory for water to be drained. The reservatory is connected at a center discharge outlet on the bottom side thereof with a drain outlet pipe and is covered with an upper strainer or grating member downstream of which insert means are arranged within the reservatory for breaking up of air that is entrapped with the water and for preventing formation of an eddy. These eddy preventing means comprise transversely extending cross baffles extending upwardly into said upper strainer and terminating in a spaced proximate relation to the bottom of the reservatory. The upper strainer of this known rainwater surface drain is either formed as a flat grate member or as a substantially dome shaped member which with an alternative design could be additionally provided at an upper position of the flat grate member for preventing debris from reaching the grating slots of the flat grate member that is positioned underneath thereof.

It is a general and quite well-known problem with such rainwater surface drains that the water entering the reservatory via the upper strainer forms a turbulence whereby any entrapped air greatly impedes the further flow of water towards the interconnected drain outlet pipe. As a result thereof water will therefore be backed up on the surface which is to be drained so that a flooding will occur.

With the arrangement of such eddy preventing means as transversely extending cross baffles no optimum solution for this particular problem has been reached, however, so that with different designs of such eddy preventing insert means trials have been made for improving the intake of water into the interconnected drain outlet pipe by substantially preventing a vortexing of the water within the reservatory in combination with a substantial prevention of air from entering into the drain outlet pipe.

Different designs have been introduced as so-called syphonic rainwater drain systems as for example disclosed in GB Patents No. 2 269 402, 2 285 460 and 2 321 067. These further known designs comprise in general a more or less funnel shaped reservatory accommodating an insert member in general in the form of a pointed cone the apex of which is directed towards the center of the inflow orifice of the drain outlet pipe. The pointed cone could also act when cooperating as a baffle means in cooperation with separate vane-like limbs which will provide distinct flow passages within the space between the pointed cone and the surrounding inner wall of the reservatory.

A further example is disclosed in the German Utility Model Registration No. 202 05 749.6 and comprises a cone shaped insert member which at a flat base surface in parallel and in spaced relation to an upper flat grate member starts with a slightly concave curvature that continues with a slightly convex curvature towards the apex of the cone. The surrounding inner wall of the reservatory is formed with corresponding complementary wall portions for providing an annular flow passage that establishes as well a syphonic effect. Such substantially cone shaped insert members result in general in an efficiency which under German standard conditions will be acceptable for drain outlet pipes with a standard nominal diameter of DN70. However the efficiency of such cone shaped insert members is not at all acceptable for drain outlet pipes having a larger nominal diameter of for example DN80 since in this case an increased amount of water is being backed up on the surface to be drained. A non-allowable flooding will therefore occur due to an impediment of the flow of water to the discharge outlet on the bottom of the reservatory.

STATEMENT OF THE INVENTION & ADVANTAGES

An object of the present invention is to provide a rainwater surface drain for use in roof drains which by comparison with a smaller nominal diameter of the drain outlet pipe will secure at least the same and preferably an increased efficiency for outlet pipes with a larger nominal diameter under standard conditions. A cone shaped insert member would be used for the evaluation of the efficiency of a surface drain of the general kind as above described and interconnected with a drain outlet pipe of a smaller and a larger nominal diameter as above mentioned.

It is a further object of the present invention to provide a rainwater surface drain for use in roof drains which is simple in design, economical in cost, and yet more efficient in operation in comparison with the known surface drains of the general kind as above described.

In accordance with the present invention a rainwater surface drain for use in roof drains is provided with an eddy preventing insert means that comprises an inner flat grate member which is disposed at a short distance upstream of the center discharge outlet on the bottom of the reservatory. The reservatory is substantially funnel-shaped towards the interconnected end of the drain outlet pipe and is provided with a peripheral inner groove for seating this inner flat grate member in a position substantially in parallel and downstream of an upper strainer or grating member which covers the reservatory whereby a reservoir is formed below the same for temporarily collecting the inflow of water.

With a rainwater surface drain according to the present invention in which the inner flat grate member is preferably supported by radially extending, circumferentially spaced supporting arms in engagement with the peripheral inner groove of the reservatory there will be achieved an empirically founded increased efficiency of up to 40 percent for the larger nominal diameter DN80 of the drain outlet pipe when using the inventive flat grate member instead of a cone shaped insert member with a design in accordance with the above mentioned German Utility Model Registration No. 202 05 749.6 which on the other side provides an optimal efficiency for the smaller nominal diameter DN70 of the drain outlet pipe that is interconnected with the reservatory of the drain. Such a flat grate member provides in a very simple manner a reduction of the amount of water which eventually will be backed up on the surface to be drained because passage of water in the direction towards the drain outlet pipe will now be detoured more or less smoothly towards the inner wall of the reservatory within the space above the inner flat grate member. This very space is now used as a reservoir for securing a minimization of the entrainment of air by substantially preventing any spiral whirling of the flow of water that enters into the reservatory.

Further features and advantages of the inventive rainwater surface drain will become apparent from the following detailed description of a preferred embodiment as schematically illustrated in the drawing.

BRIEF DESCRIPTION OF THE DRAWINGS

The invention will now be described by way of example with reference to the accompanying drawings, in which.

DETAILED DESCRIPTION OF THE PREFERRED EMBODYMENT

Figure 1:
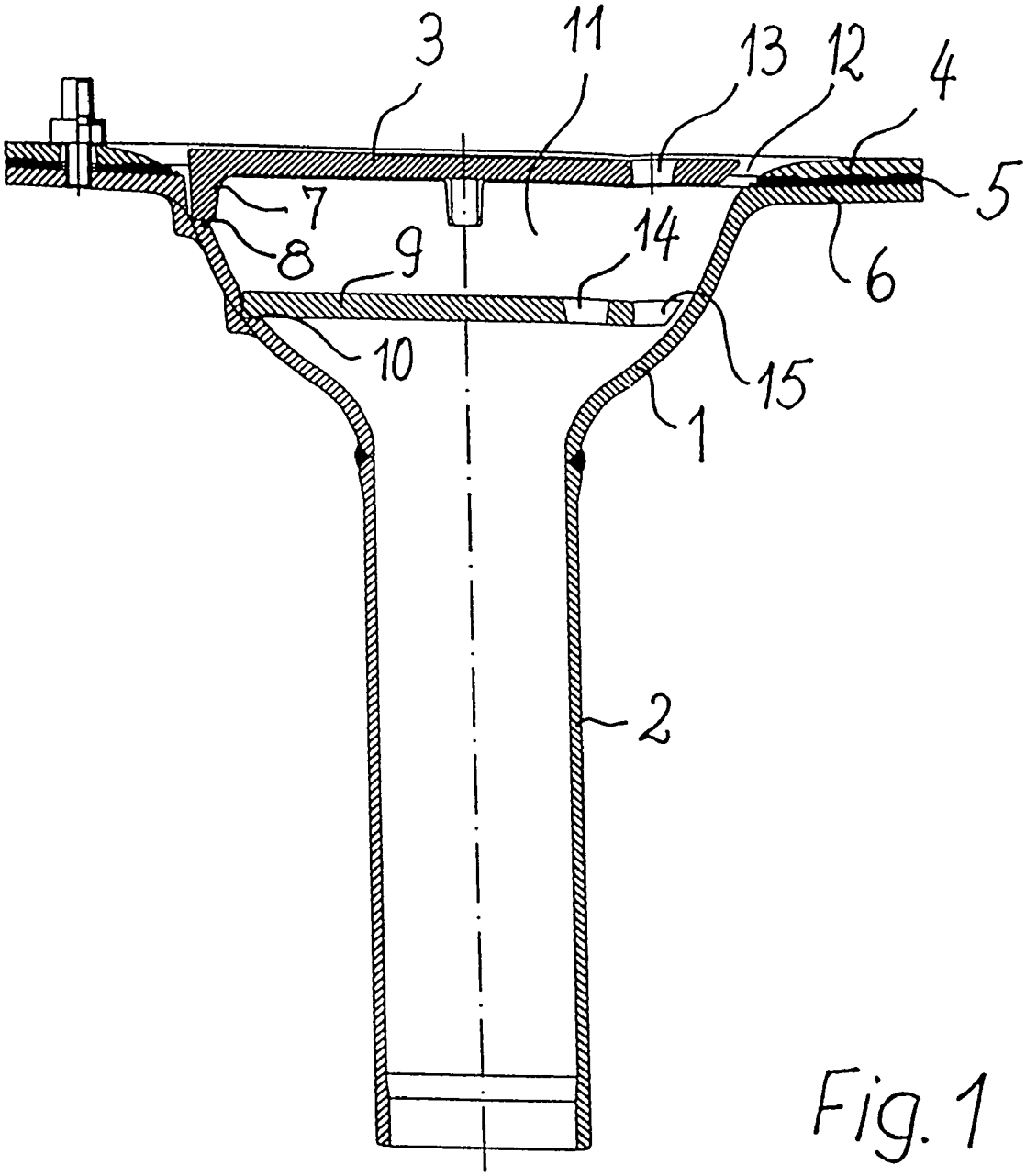
FIG. 1 is a sectional illustration of the inventive rainwater surface drain in accordance with a preferred embodiment comprising a flat grate member as an upper strainer for covering a funnel-shaped reservatory of the surface drain and an inner eddy preventing insert also in the form of a flat grate member.

FIG. 1 illustrates a rainwater surface drain which is intended for use in roof drains or other comparable surfaces to be drained. This surface drain comprises a substantially funnel-shaped reservatory 1 and a drain outlet pipe 2 which is connected to the reservatory at a discharge outlet on the bottom side thereof. The reservatory 1 is covered with a strainer or grating member 3 that is formed as a flat grate member the upper surface of which is substantially plane with the roof surface. With an alternative embodiment this upper strainer or grating member could also be dome shaped and with a further alternative embodiment such a dome shaped strainer could also be provided in addition to the illustrated flat grate member.

In the same plane as the flat grate member 3 there is further provided a loose flange 4 which is backed with a seal 5 and which is secured to an annular flange 6 of the reservatory 1 by screw bolts that are arranged along the circumference of the flat grate member.

The flat grate member 3 is provided with centering lugs 7 projecting downwardly for supporting the flat grate member 3 on a peripheral annular shoulder 8 of the reservatory. At a short distance below the flat grate member 3 there is further provided another flat grate member 9 as an eddy preventing insert means inside of the reservatory and in engagement with a peripheral inner groove 10 of the reservatory 1. A collecting space or reservoir 11 is therefore presented between the upper flat grate member 3 and this inner flat grate 9 which is connected on the one side with a peripheral inflow groove 12 as established by the loose flange 4 in cooperation with an edge portion of the flat grate member 3 and of course also with the plurality of grating openings 13 with which the flat grate member 3 is provided.

Figure 2:
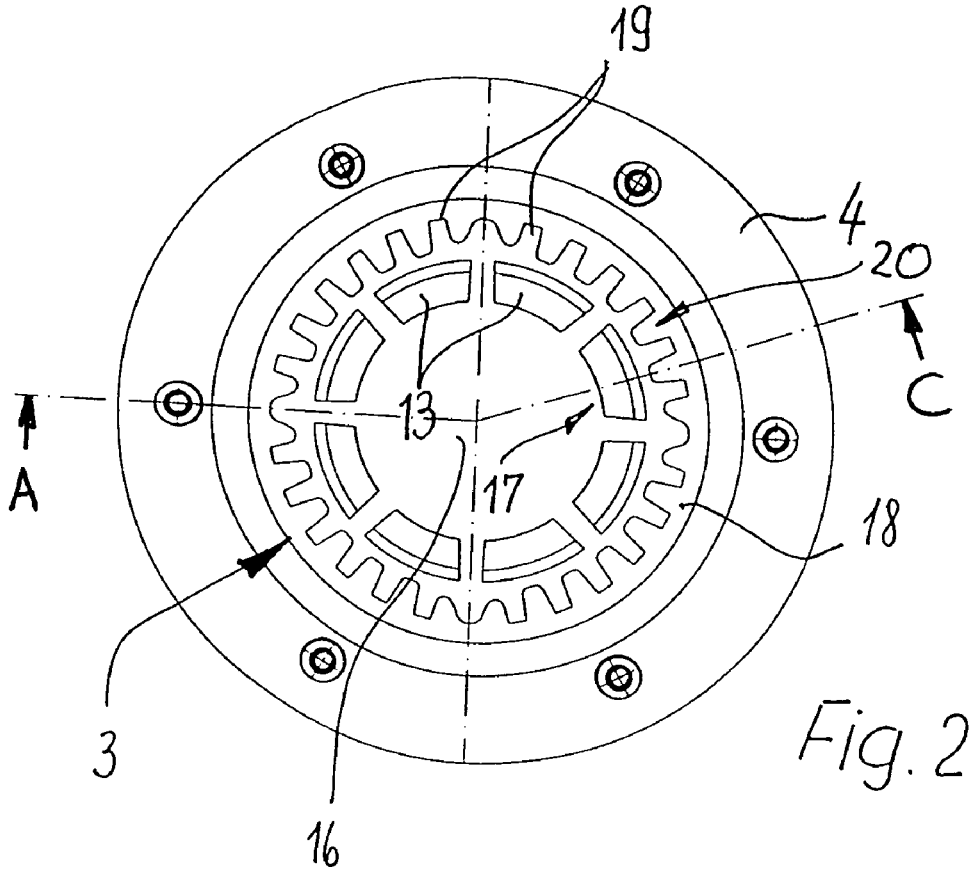
FIG. 2 is a top view of the upper grate member and defining as well the line of intersection A-C which is considered for the sectional illustration of FIG. 1.
Figure 3:
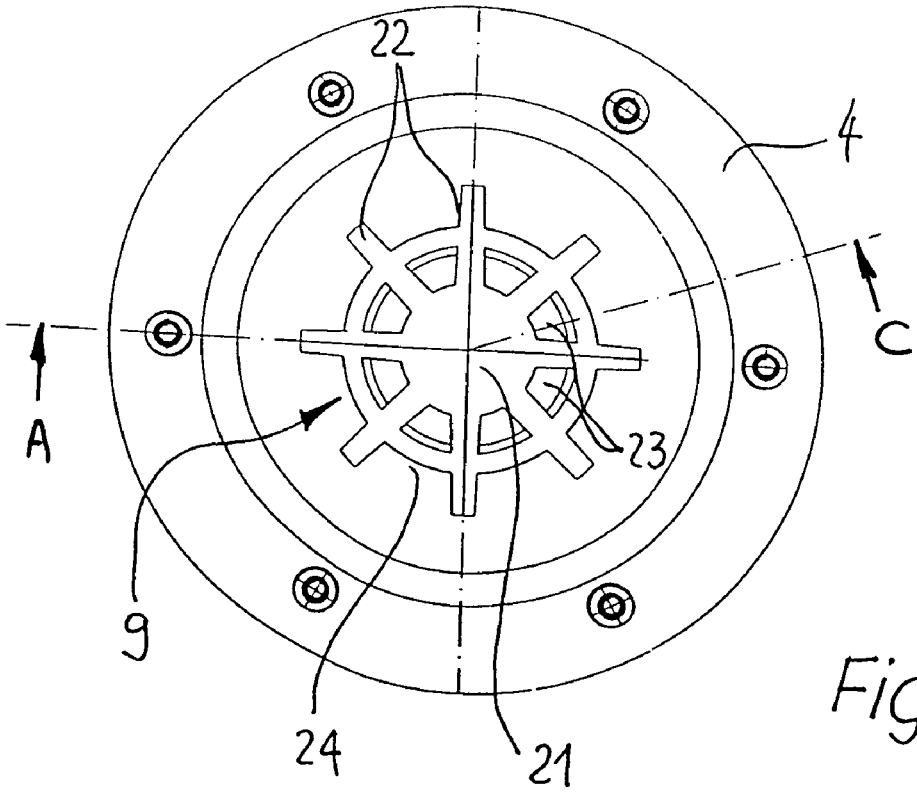
FIG. 3 is a top view of the inner flat grate used as an eddy preventing insert whereby the same line of intersection is presented which is used for the sectional illustration of FIG. 1.

The collecting space or reservoir 11 is on the other side connected with the discharge outlet on the bottom side of the reservatory 1 via a similar plurality of grating openings 14 of the inner flat grate member 9 and further via a peripheral annular gap 15 which is provided between the edge portion of the inner flat grate member 9 and the surrounding inner wall of the reservatory. As illustrated in FIGS. 2 and 3 the two flat grate members 3 and 9 are substantially of the same design whereby the upper flat grate member 3 serving as a lid member for covering the reservatory 1 at its entrance orifice is somewhat larger dimensioned than the inner flat grate member 9 the smaller dimension of which is of course predetermined by the funnel-shape of the surrounding wall of the reservatory.

As particularly illustrated in FIG. 2 the upper flat grate member 3 comprises a disk-shaped center portion 16 which is surrounded by a ring 17 of the before mentioned grating openings 13 formed as circumferentially extending slots that are surrounded by a closed outer annulus 18 into which radially extending webs 19 of the disk-shaped center portion 16 are projecting outwardly of the grating openings 13. With theses circumferentially spaced webs 19 a further ring 20 of a plurality of further grating slots is provided which predetermine the dimensioning of the peripheral inflow groove 12 that is established by the loose flange 4.

Due to its substantially same design the inner flat grate member 9 is as well provided with a disk-shaped center portion 21 having radially extending supporting arms 22 that are circumferentially spaced for engagement with the peripheral inner groove 10 of the reservatory 1. The supporting arms 22 are projecting over a ring of grating openings 23 and an outer closed annulus 24. The number of supporting arms 22 is less than the number of webs 19 of the flat grate member 3 so that even that the flat grate member 3 is larger dimensioned than the flat grate member 9 there are provided respectively larger spaces between the supporting arms 22. With the entirety of these intermediate spaces a respectively large cross-sectional dimension is therefore provided for the annular gap between the edge portion of the flat grate member 9 and the surrounding funnel-shaped wall of the reservatory 1. The supporting arms 22 provide a channelling of the water which is collected within the reservoir 11 in a direction towards the upper end of the interconnected drain outlet pipe 2 so that as a result of this channelling at a front surface of the surrounding inner wall of the reservatory 1 a respectively high efficiency is being obtained for the drain of the rainwater which reaches the upper strainer. Since the reservoir is acting as a pool for slowing down the velocity of the inflowing water any whirling motion of the water will be prevented so that the efficiency of the out flowing water being passed through the grating openings of the inner flat grate member 9 and its surrounding annular gap 15 will be improved.

It should be understood that within the scope of the present invention and its above described preferred embodiment design details could receive changes such as for example the peripheral groove which is provided for seating the inner flat grate member 9 by the projecting ends of its supporting arms 22. This very peripheral groove could be replaced by pocket shaped recesses of the inner wall of the reservatory. The number and design of the grating openings could further as well be different from the number and design as above described for the preferred embodiment.

What I claim is:

1. A surface drain, comprising a reservatory for water to be drained, the reservatory being connected at a center discharge outlet on the bottom side thereof with a drain outlet pipe and being covered with an upper strainer or grating member downstream of which insert means are arranged within the reservatory for breaking up of air entrapped with the water and for preventing formation of an eddy, wherein said eddy preventing insert means comprise an inner flat grate member which is disposed at a short distance upstream of said center discharge outlet of the reservatory, wherein said reservatory is substantially funnel-shaped towards the interconnecting end of the drain outlet pipe and is provided with a peripheral inner groove for seating the inner flat grate member in a position substantially in parallel and downstream of said upper strainer or grating member whereby a reservoir is formed by the space between the upper strainer or grating member and the inner flat grate member for temporarily collecting the inflow of water before its passage to the drain outlet pipe, wherein said inner flat grate member comprises radially extending circumferentially spaced supporting arms in engagement with the peripheral inner groove of the reservatory, and wherein said inner flat grate member comprises a disk-shaped center portion which is surrounded by a plurality of encircling coaxial grating slots inside of an outer closed annulus over which the radially extending supporting arms project for engagement with the peripheral inner groove of the reservatory.

2. The surface drain according to claim 1, wherein at least one grating slot is provided in the space between any two adjacent, circumferentially spaced supporting arms.

3. A surface drain, comprising a reservatory for water to be drained, the reservatory being connected at a center discharge outlet on the bottom side thereof with a drain outlet pipe and being covered with an upper strainer or grating member downstream of which insert means are arranged within the reservatory for breaking up of air entrapped with the water and for preventing formation of an eddy, wherein said eddy preventing insert means comprise an inner flat grate member which is disposed at a short distance upstream of said center discharge outlet of the reservatory, wherein said reservatory is substantially funnel-shaped towards the interconnecting end of the drain outlet ripe and is provided with a peripheral inner groove for seating he inner flat grate member in a position substantially in parallel and downstream of said upper strainer or grating member whereby a reservoir is formed by the space between the upper strainer or grating member and the inner flat grate member for temporarily collecting the inflow of water before its passage to the drain outlet pipe, wherein said upper strainer or grating member is formed as a further flat grate member substantially of the same design as said inner flat grate member and in engagement with an annular shoulder surrounding an upper margin of the reservatory, and wherein said inner and said further flat grate members are both provided with an equal number of grating slots in each quadrant of the respective surface area of each flat grate member, and the grating slots of the further flat grate member are surrounded by a large number of circumferentially spaced webs that radially extend towards an outer closed annulus which is in a seating engagement with an annular shoulder at the margin of the reservatory whereby a plurality of further radially extending grating slots are provided between the radially extending webs.

4. A surface drain, comprising a reservatory for water to be drained, the reservatory being connected at a center discharge outlet on the bottom side thereof with a drain outlet pine and being covered with an upper strainer or grating member downstream of which insert means are arranged within the reservatory for breaking up of air entrapped with the water and for preventing formation of an eddy, wherein said eddy preventing insert means comprise an inner flat grate member which is disposed at a short distance upstream of said center discharge outlet of the reservatory, said reservatory is substantially funnel-shaped towards the interconnecting end of the drain outlet pipe and is provided with a peripheral inner groove for seating the inner flat grate member in a position substantially in parallel and downstream of said upper strainer or grating member whereby a reservoir is formed by the space between the upper strainer or grating member and the inner flat grate member for temporarily collecting the inflow of water before its passage to the drain outlet pipe, and wherein said upper strainer or grating member is surrounded by a loose flange that is secured to the reservatory such as to establish a peripheral inflow groove in cooperation with an edge portion of the upper strainer or grating member which comprises downwardly projecting centering lugs in seating engagement with an annular shoulder of the reservatory.

* * * * *